US005443406A

United States Patent [19]

Mondek et al.

[11] Patent Number: 5,443,406

[45] Date of Patent: Aug. 22, 1995

[54] VIBRATION ISOLATING MOUNTING FOR OUTBOARD MOTOR

[75] Inventors: Martin J. Mondek, Wonder Lake; Donald K. Sullivan, Prospect Heights, both of Ill.

[73] Assignee: Outboard Marine Corporation, Waukegan, Ill.

[21] Appl. No.: 126,784

[22] Filed: Sep. 24, 1993

[51] Int. Cl.[6] ..... B63H 21/30

[52] U.S. Cl. ..... 440/52; 248/640; 267/141.2

[58] Field of Search ..... 440/52; 248/635, 640; 267/153, 141.2

[56] References Cited

U.S. PATENT DOCUMENTS

| | | | |
|---|---|---|---|
| 2,740,368 | 4/1956 | Irgens et al. | 440/52 |
| 2,911,936 | 10/1959 | Kiekhaefer | 440/52 |
| 2,916,007 | 12/1959 | Kiekhaefer | 440/52 |
| 3,002,489 | 10/1961 | Watkins | 440/52 |
| 3,045,423 | 7/1962 | Hulsebus | 60/32 |
| 3,127,866 | 4/1964 | Mohr | 440/52 |
| 3,358,668 | 12/1967 | Post et al. | 123/198 |
| 3,599,594 | 8/1971 | Taipale | 440/52 |
| 3,750,615 | 8/1973 | Haft et al. | 440/52 |
| 3,782,321 | 1/1974 | Ellingsen | 440/52 |
| 3,934,537 | 1/1976 | Hall | 440/52 |
| 4,507,090 | 3/1985 | Kobayashi et al. | 440/52 |
| 4,546,848 | 10/1985 | Iijima et al. | 180/312 |
| 4,889,578 | 12/1989 | Kei et al. | 267/141.2 |
| 4,979,918 | 12/1990 | Breckenfeld et al. | 440/52 |
| 5,180,319 | 1/1993 | Shiomi et al. | 248/640 |
| 5,192,235 | 3/1993 | Dunham et al. | 440/52 |

FOREIGN PATENT DOCUMENTS

| | | | |
|---|---|---|---|
| 57-126794 | 8/1982 | Japan | 440/52 |

*Primary Examiner*—Jesus D. Sotelo
*Attorney, Agent, or Firm*—Michael, Best & Friedrich

[57] ABSTRACT

Disclosed herein is a marine propulsion device comprising a propulsion unit assembly having forwardly located laterally spaced portions respectively including laterally aligned outwardly opening sockets and laterally aligned horizontally extending apertures communicating with the sockets, a king pin assembly including a portion located between the laterally extending portions and including a laterally extending bore aligned with the apertures, rubber mount assemblies respectively engaged in the sockets and having respective bores in alignment with the bore in the king pin assembly, a laterally extending bolt projecting through the bores and through the apertures in spaced relation thereto and including a head engaging one of the rubber mount assemblies, and a nut threaded on the bolt and engaging the other of the rubber mount assemblies.

15 Claims, 3 Drawing Sheets

VIBRATION ISOLATING MOUNTING FOR OUTBOARD MOTOR

BACKGROUND OF THE INVENTION

The invention relates generally to marine propulsion devices such as outboard motors and to arrangements, in an outboard motor, for supporting and vibrationally isolating a propulsion unit from a steering arm and a boat.

Attention is directed to the following documents which disclose various arrangements for supporting and isolating a propulsion unit from a boat hull and a steering arm.

U. S. Pat. Nos.

| | | |
|---|---|---|
| 2,740,368 | Irgens, et al. | April 3, 1956 |
| 2,911,936 | Kiekhaefer | November 10, 1959 |
| 2,916,007 | Kiekhaefer | December 8, 1959 |
| 3,002,489 | Watkins | October 3, 1961 |
| 3,045,423 | Hulsebus | July 24, 1962 |
| 3,127,866 | Mohr | April 7, 1964 |
| 3,358,668 | Post, et al. | December 19, 1967 |
| 3,599,594 | Taipale | August 17, 1971 |
| 3,750,615 | Haft, et al. | August 7, 1973 |
| 3,782,321 | Ellingsen | January 1, 1974 |
| 3,934,537 | Hall | January 27, 1976 |
| 4,507,090 | Kobayashi, et al. | March 26, 1985 |
| 4,546,848 | Iijima, et al. | October 15, 1985 |
| 4,979,918 | Breckenfeld, et al. | December 25, 1990 |
| 5,192,235 | Dunham, et al. | March 9, 1993 |

Foreign

Japanese Patent Application No. 57-126794

SUMMARY OF THE INVENTION

The invention provides a marine propulsion device comprising a drive shaft housing having laterally spaced portions respectively including laterally aligned outwardly opening sockets, a king pin assembly including a portion located between the laterally extending portions, rubber mount assemblies including outer sleeves respectively engaged in the sockets, inner sleeves, and rubber cores bonded to and extending between the inner and outer sleeves, and means for fastening the inner sleeves to the portion of the king pin assembly.

The invention also provides an outboard motor comprising a drive shaft housing having forwardly located laterally spaced portions respectively including laterally aligned sockets respectively including vertically extending bottom walls respectively having therein horizontally extending apertures laterally aligned with each other and respective cylindrical walls extending from the bottom walls and opening laterally outwardly, a drive shaft extending vertically in the drive shaft housing, a king pin assembly comprising a steering arm including a forwardly projecting portion located between the laterally extending portions and including a laterally extending bore aligned with the apertures, and a vertically extending aperture located forwardly of the bore and through which the drive shaft passes in spaced relation to the steering arm portion, rubber mount assemblies respectively engaged in the sockets and respectively including a rigid outer sleeve having a cylindrical outer surface, a rigid inner sleeve including an outer end and having a bore which is located in alignment with the bore in the king pin assembly and which is elongated in the fore and aft direction, and a resilient rubber core bonded to the inner and outer sleeves, a laterally extending bolt projecting through the bore in the steering arm portion in engagement therewith, through the bores in the inner sleeves, and through the bottom wall apertures in spaced relation thereto and including a head engaging the outer end of one of the inner sleeves, and a nut threaded on the bolt and engaging the outer end of the other of the inner sleeves.

Other features of and advantages of the invention will become apparent to those skilled in the art upon review of the following detailed description, claims, and drawings.

THE DRAWINGS

Figure 1:
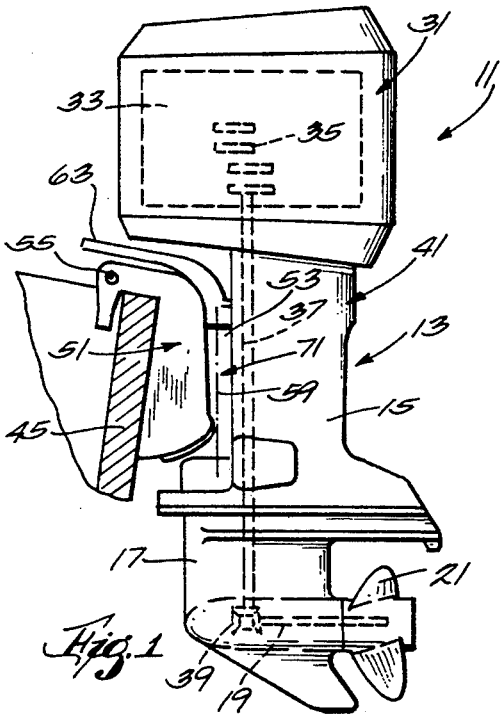
FIG. 1 is a side elevational view of an outboard motor embodying various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION

Shown in the drawings is a marine propulsion device which is in the form of an outboard motor 11 and which includes a steerable and tiltable propulsion unit 13 including a drive shaft housing 15 having a lower end fixedly connected to a gear case 17 rotatably supporting a propeller shaft 19 carrying a propeller 21.

The propulsion unit 13 also includes a powerhead 31 including an internal combustion engine 33 rigidly fixed to the top of the drive shaft housing 15 and including a crankshaft 35 which is drivingly connected to a drive shaft 37 extending vertically in the drive shaft housing 15 and connected to the propeller shaft 19 through a reversing transmission 39.

The rigidly connected engine 33 and drive shaft housing 15 constitute a rigid propulsion unit assembly 41.

The outboard motor 11 also includes means adapted for supporting the propulsion unit 13 from a boat transom 45 for tilting and steering movement. While other constructions can be employed, in the disclosed construction, such means comprises a transom bracket 51 adapted to be fixed to the boat transom 45, and a swivel bracket 53 which is connected to the transom bracket 51 for vertically swingable tilting movement about a horizontal tilt axis 55 relative to the transom bracket 51 and which includes a bore extending transversely to the tilt axis 55, defining a steering axis 59, and receiving a king pin 61 which, at its upper end, is fixed to a steering arm 63. The king pin 61 and steering arm 63 comprise a king pin or steering arm assembly 71.

Means are also provided on the upper and lower ends of the king pin assembly 71 and on the rigid propulsion unit assembly 41 for connecting (and supporting) the propulsion unit 13 and the swivel bracket 53 for tilting movement about the tilt axis 55 in common with the swivel bracket 53, for steering movement of the propulsion unit 13 relative to the swivel bracket 53 about the steering axis 59, and for vibrationally isolating the propulsion unit 13 from the king pin assembly 71 and consequently from the steering arm 63, the swivel bracket 53, and the boat transom 45.

Any suitable means can be employed for steerably connecting and vibrationally isolating the lower end of the king pin assembly 71 and the rigid propulsion unit assembly 41.

As thus far disclosed, the construction is conventional.

At the upper end of the king pin assembly, the means for steerably connecting and vibrationally isolating the king pin assembly 71 and the rigid propulsion unit assembly 41 comprises a pair of laterally spaced forwardly projecting portions 75 on the rigid propulsion unit assembly 41. While the projecting portions 75 can be provided on the engine 33, in the disclosed construction, the projecting portions 75 are provided on the drive shaft housing 15.

The projecting portions 75 define therebetween a space 77 and respectively include isolator sockets 79 which extend in the direction away from the space 77, which are laterally outwardly open, and which are respectively defined by radially extending bottom walls 81 and by cylindrical walls 83 extending laterally outwardly from the bottom walls 81. The bottom walls 81 respectively include aligned apertures 85.

Extending into the space 77 between the projecting portions 75 is a steering arm portion 91 which is a part of the king pin assembly 71, which is spaced from the drive shaft housing 15 so as to prevent engagement therebetween during vibration of the rigid propulsion unit assembly 41, and which includes a horizontal transverse bore 95 which is generally coaxial with the apertures 85 in the projecting portions 75, but which is smaller in diameter than the apertures 85.

In addition, the rearwardly extending steering arm portion 91 of the king pin assembly 71 includes a vertically extending aperture 97 which is located forwardly of the transverse bore 95 and which affords passage therethrough of the drive shaft 37 with sufficient clearance to prevent engagement between the drive shaft 37 and the steering arm portion 91, notwithstanding vibration of the rigid propulsion unit assembly 41 relative to the king pin assembly 71.

Located in the sockets 79 are respective rubber mount assemblies 101 which connect and vibrationally isolate the rigid propulsion unit assembly 41 from the king pin assembly 71. While various rubber mount assembly constructions can be employed, in the disclosed construction, the rubber mount assemblies 101 respectively include outer rigid or metallic sleeves or members 103 having respective cylindrical outer surfaces 105 engaged in the applicable one of the sockets 79. In addition, the outer sleeves 103 respectively include inner surfaces 107 which are generally cylindrical except for a rearwardly located, radially inwardly extending projection or enlargement 109, and upper and lower flat surface portions 111 and 113 which slightly forwardly converge.

The rubber mount assemblies 101 also respectively include inner rigid or metallic sleeves or members 121 respectively located in inwardly spaced relation from the outer sleeves 103. While other constructions can be employed, in the illustrated construction, the inner sleeves 121 include transversely extending, horizontally elongated hollow bores 123 defined by flat parallel upper and lower sides 125 and 127 and rearward and forward semi-circular end portions 129 and 131 extending from the ends of the sides 125 and 127. The spacing of the sides 125 and 127 from each other is greater than the diameter of the bore 95 in the steering arm portion 91 and is smaller than the apertures 85 in the bottom walls 81 of the sockets 79. The inner sleeves 121 each include an outer surface 128 which includes flat parallel upper and lower surface portions 130 and 132, and rearward and forward semi-cylindrical surface portions 134 and 136.

The rubber mount assemblies 101 also include respective rubber cores or members 141 which are bonded to the inner and outer sleeves 103 and 121. While various rubber core constructions can be employed, in the disclosed construction, the rubber cores 141 include upper and lower web portions 143 and 145 which respectively extend between, and are bonded to, the upper and lower flat surface portions 130 and 132 of the inner sleeve 121 and the converging upper and lower flat surfaces 111 and 113 of the inner surface 107 of the outer sleeves 103. The web portions 143 and 145 extend forwardly along the outer surface of the inner sleeves 121 until approximately the horizontal mid-plane 147 of the rubber mount assemblies 101.

The rubber cores 141 also include thin upper and lower forward portions 151 and 153 which respectively extend forwardly from the web portions 143 and 145 along the inner surface 107 of the outer sleeve 103 and connect with a bumper portion 155 which is substantially symmetrically arranged around the rubber mount assembly mid-plane 147 and which is defined by a forward, partially circular portion of the inner surface 107 of the outer sleeve 103 and by upper and lower surfaces 161 and 163 which extend rearwardly and toward each other, terminating at a point or edge 165 which is spaced forwardly from the forward semi-circular end portion 136 of the outer surface 128 of the inner sleeve 121 and in position to be engaged by the inner sleeve 121 consequent to movement of the upper portion of the propulsion unit 13 rearwardly relative to the king pin assembly 71, thereby limiting such rearward movement of the top of the rigid propulsion unit assembly 41 relative to the king pin assembly 71.

The rubber cores 141 also include thin upper and lower rearward portions 171 and 173 which respectively extend rearwardly from the web portions 143 and 145 along a rearward partially circular portion of the inner surface 107 of the outer sleeve 103 until about the horizontal mid-plane 147 and until engagement with the forwardly projecting enlargement or projection 109 on the inner surface 107 of the outer sleeve 103. Such relation assists in preventing rotary movement of the rubber cores 141 relative to the outer sleeves 103. The rubber cores 141 are fabricated of resilient rubber like material having the same durometer throughout.

Means are also provided for readily accessible and releasable assembly of the rearwardly extending steering arm portion 91 and the inner sleeves 121 of the rubber mount assemblies 101. In this regard it is noted that prior to assembly of the rubber mount assemblies 101 to the portion 91 of the steering arm 63 and to the sockets 79, the inner ends of the inner sleeves 121 extend through the apertures 85 and are spaced from the adjacent side surfaces of the steering arm portion 91 by gaps or spaces which are, preferably, about 0.070 inches before completion of assembly. When fully assembled, these spaces or gaps are eliminated, thus axially precompressing the rubber cores 141 a predetermined amount. While other constructions can be employed, in the construction illustrated in FIG. 3, a bolt 181, with an enlarged head 183 and an elongated shank 185 extending from the head 183, projects through the bore 95 in the rearward portion 91 of the steering arm 63 of the king pin assembly 71 and through the bores 123 in the inner sleeves 121. Relatively enlarged washers 186 are provided on the shank 185 laterally outwardly of the outer ends of the inner sleeves 121 and in position for abutting engagement with the outer ends of the inner sleeves 121. The shank 185 includes an outer end 187 located remotely from the head 183 and adapted to be threadedly engaged by a nut 189 until the laterally outer ends of the inner sleeves 121 are engaged by the head 183 and the nut 189 and until the inner ends of the inner sleeves 122 engage the side surfaces 124 of the steering arm portion 91. It is noted that the outer surface of the shank 185 engages the inner surface of the transverse bore 95 in the rearwardly extending portion 91 of the steering arm or king pin assembly 71, and is assembled in fixed relation to the inner sleeves 121 of the rubber mount assemblies 101. It is also noted that vibration of the rigid propulsion unit assembly 41 relative to the king pin assembly 71 is permitted without contact therebetween and that the inner ends of the outer sleeves 103 of the rubber mount assemblies are engaged with the bottom walls 81 of the sockets 79. It is also noted that the disclosed construction permits assembly (and disassembly) of the rubber mount assemblies 101 to the rigid propulsion unit assembly 41 and to the king pin assembly 71 by means of the single horizontally and transversely extending bolt 181 and locates the head 183 and the nut 189 on opposite sides of the rigid propulsion unit assembly 41 in readily accessible location to enable such assembly and disassembly.

In operation, the rigid propulsion unit assembly 41 vibrates relative to the king pin assembly 71 without substantially imparting vibration to the king pin assembly 71 and without engaging the steering arm portion 91 and the connecting bolt 181. When the outboard motor 11 develops forward thrust, such thrust is transmitted, in part, to the king pin assembly 71 by rearward movement of the drive shaft housing 15 and the projecting portions 75 thereof with respect to the bolt 181 which is fixed relative to the king pin assembly 71. Such movement is somewhat restricted by the upper and lower converging surfaces 111 and 113 of the outer sleeve 103 and is ultimately limited by engagement of the inner sleeves 121 with the bumper portions 155 of the rubber cores 141.

Figure 6:
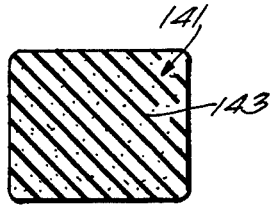
FIG. 6 is a sectional view taken along line 6—6 of FIG. 5.
Figure 4:
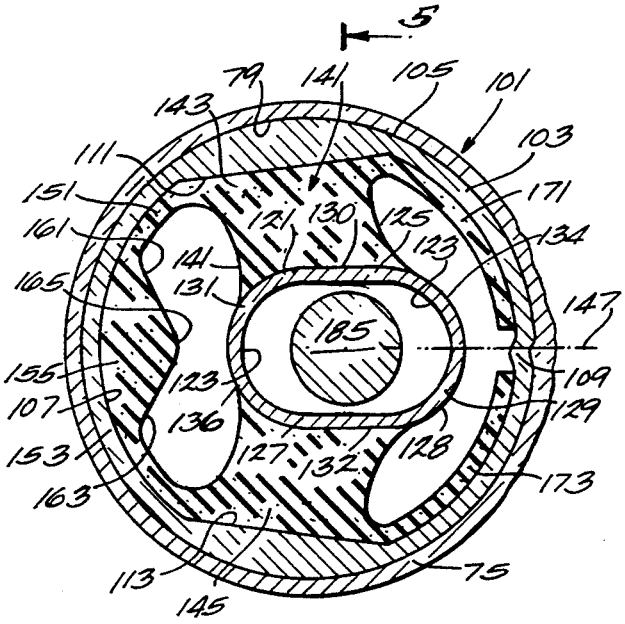
FIG. 4 is a sectional view taken along line 4—4 of FIG. 3.
Figure 5:
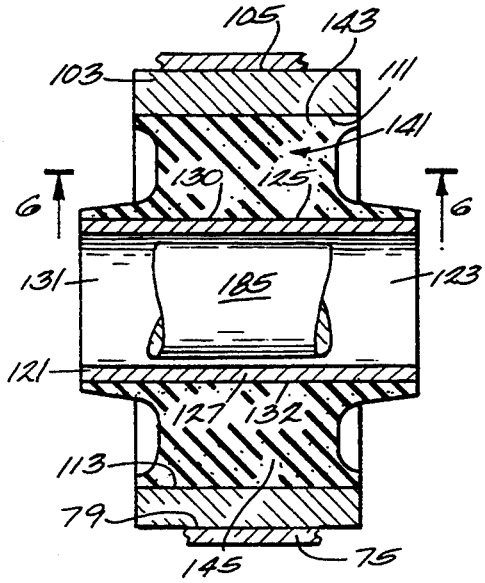
FIG. 5 is a sectional view taken along line 5—5 of FIG. 4.
Figure 3:
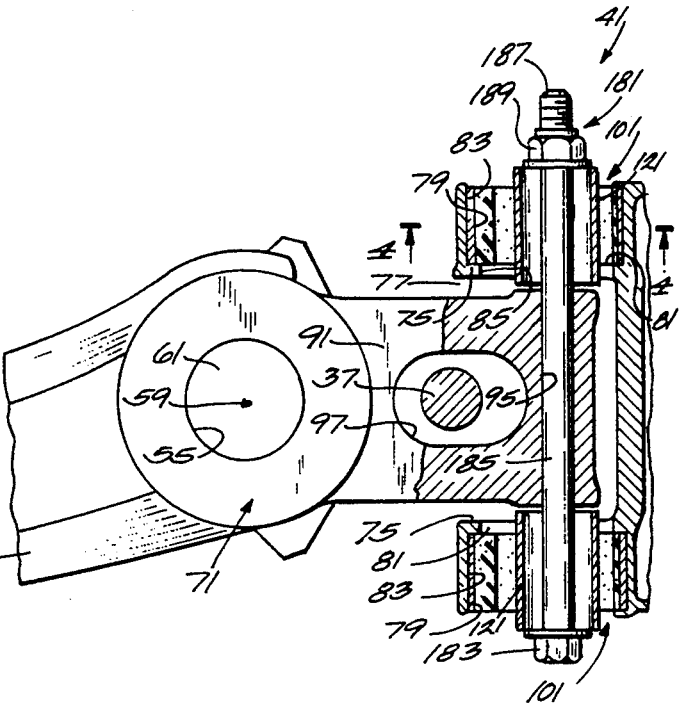
FIG. 3 is an enlarged fragmentary top view of a portion of the outboard motor shown in FIG. 2.
Figure 2:
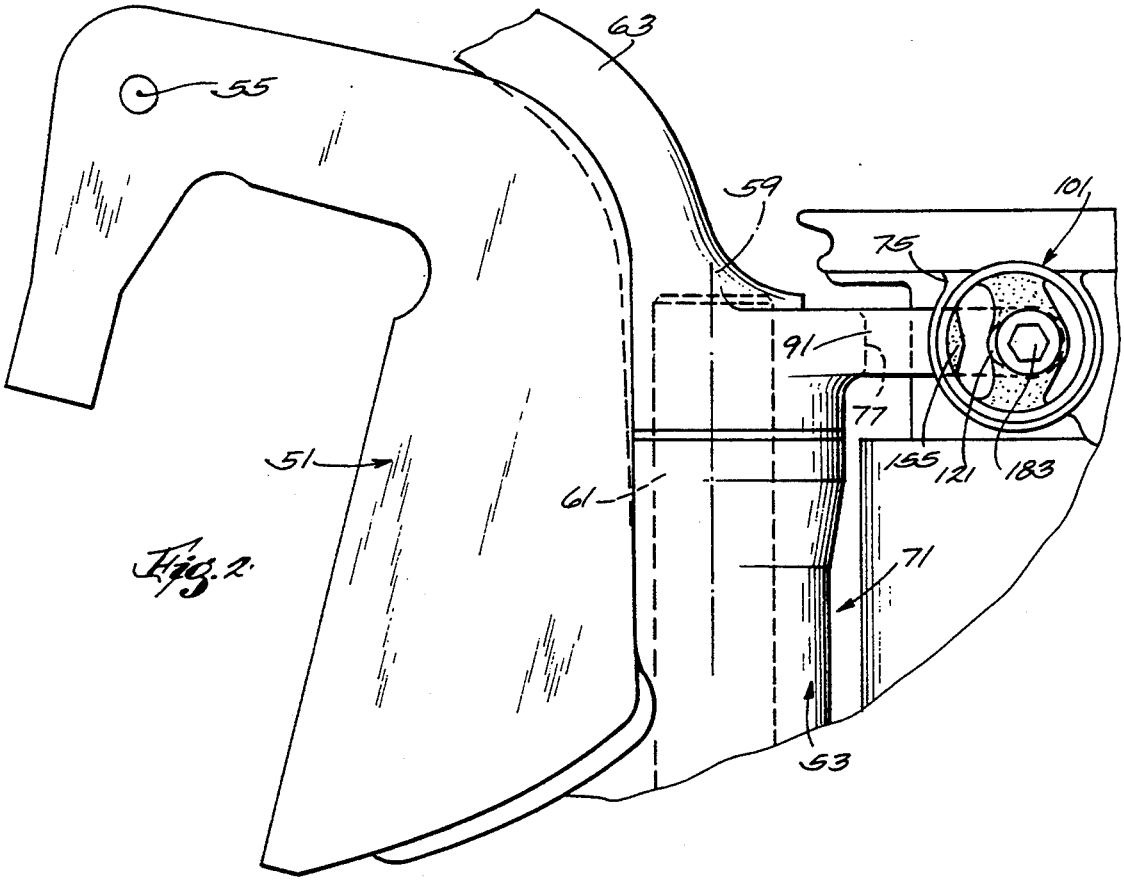
FIG. 2 is an enlarged fragmentary elevational view of a portion of the outboard motor shown in FIG. 1.
Figure 7:
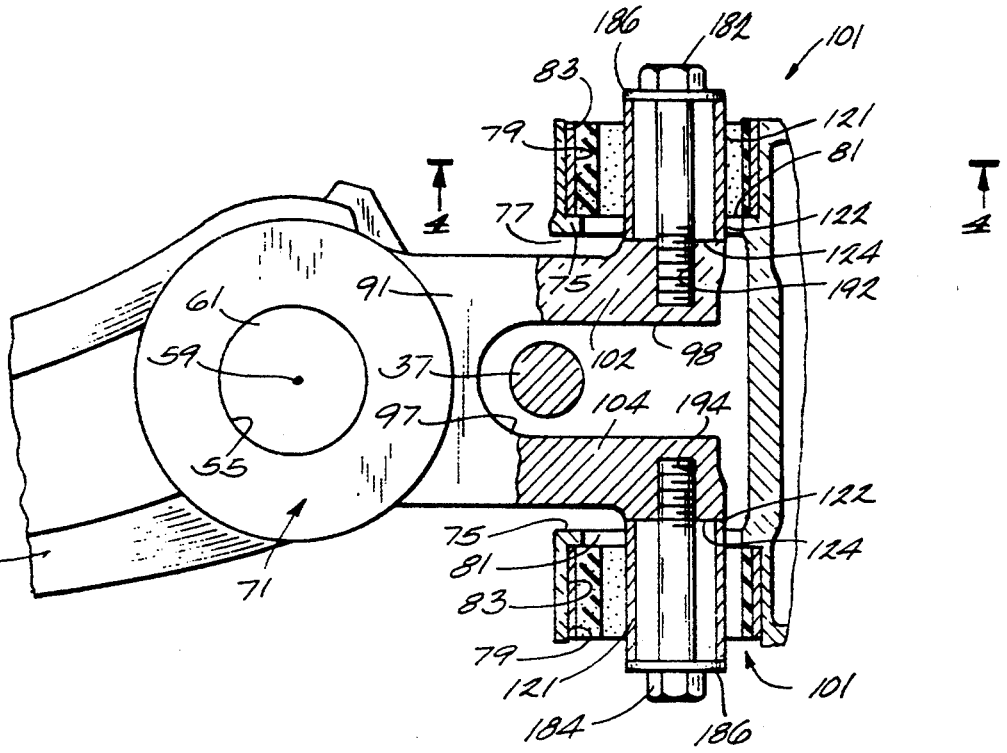
FIG. 7 is a fragmentary top view of a portion of an other embodiment incorporation various of the features of the invention.

Shown in FIG. 7 is another embodiment of the invention wherein the same reference numerals as used in the embodiment shown in FIG. 3 have been applied to the same elements of the embodiment shown in FIG. 6. The construction shown in FIG. 7 is the same as shown in FIG. 3 except that the aperture 97 becomes a rearwardly open slot 98 so that the aft part of the steering arm portion 91 includes two laterally spaced rearwardly projecting fingers 102 and 104. The construction shown in FIG. 7 also differs from the construction shown in FIG. 3 in that, instead of the single bolt 181, the rubber mount assemblies 101 are maintained in the sockets 79 by bolts 182 and 184 which are respectively threaded into bores 192 and 194 in the fingers 102 and 104.

Construction of the inner sleeves 121 with the flat face surface portions 130 and 132 which are elongated in the fore and aft direction advantageously provides for increasing the bonding area between the rubber cores 141 and the inner sleeves 121, thereby improving the strength of the bond, for lessening the weight carried per unit area by the web portions 143 when the outboard motor is at rest, and for limiting or controlling the spacing between the forward end of the inner sleeves 121 and the bumper portion 155, and thereby limiting the extent of possible rearward movement of the outer sleeves 103 relative to the inner sleeves 121 to a distance less than the distance between the flat surface portions 130 and 132 of the inner sleeves 121 and the flat converging surface portions 111 and 113 of the outer sleeves 103.

The disclosed construction provides the ability to obtain better engine isolation, part count reduction and resulting cost savings. The mounting arrangement is symmetrical, thereby allowing installation in either position, and provides easy modification to alter damping characteristics. In addition, in one embodiment, installation is simplified and requires a single mounting bolt that attaches the rubber mounts to the steering arm bracket.

Various of the features of the invention are set forth in the following claims.

We claim:

1. A marine propulsion device comprising a propulsion unit assembly having laterally spaced portions respectively including laterally aligned outwardly opening sockets, a king pin assembly including a portion located between said laterally extending portions, rubber mount assemblies including outer sleeves respectively engaged in said sockets, inner sleeves, and rubber cores bonded to and extending between said inner and outer sleeves, and means for fastening said inner sleeves to said portion of said king pin assembly.

2. A marine propulsion device in accordance with claim 1 wherein said sockets respectively include therein laterally open apertures, wherein said fastening means includes a laterally extending bolt projecting through said rubber mount assemblies and through said apertures in spaced relation thereto and including a head engaging the outer end of one of said inner sleeves of said rubber mount assemblies, and a nut threaded on said bolt and engaging the outer end of the other of said inner sleeves of said rubber mount assemblies.

3. A marine propulsion device in accordance with claim 2 wherein said propulsion unit includes a drive shaft housing which includes said laterally spaced portions and a vertically extending drive shaft, wherein said bolt is located aft of said drive shaft, and wherein said king pin portion includes an aperture through which said drive shaft extends in spaced relation to said king pin portion.

4. A marine propulsion device in accordance with claim 2 wherein said sockets respectively include vertically extending bottom walls having therein said apertures, and respective cylindrical walls extending respectively from said bottom walls and opening laterally outwardly.

5. A marine propulsion device in accordance with claim 1 wherein each of said inner sleeves has therein a bore which is elongated in the fore and aft direction.

6. A marine propulsion device in accordance with claim 1 wherein said outer sleeves include an inner surface having upper and lower flat and forwardly convergent surface portions, wherein said inner sleeves include an outer surface including flat upper and lower surface portions, and wherein said rubber cores include upper and lower web portions respectively extending between said flat upper and lower surface portions of said outer surfaces of said inner sleeves and said flat upper and lower surface portions of said inner surfaces of said outer sleeves.

7. A marine propulsion device in accordance with claim 6 wherein said inner surfaces of said outer sleeves include a forward surface portion, wherein said outer surfaces of said inner sleeves include a forward surface portion, and wherein said rubber cores include bumper portions extending from said forward surface portions of said inner surfaces of said outer sleeves and terminating in spaced relation to said forward surface portions of said inner sleeves.

8. A marine propulsion device in accordance with claim 7 wherein said inner surfaces of said outer sleeves include a rearwardly located surface portion having a forwardly extending projection, wherein said outer surfaces of said inner sleeves include a rearward surface portion, and wherein said rubber cores include portions extending along said inner surfaces of said outer sleeves from said web portions and in spaced relation to said rearward surface portions of said outer surfaces of said inner sleeves and to adjacent said projections on said inner surfaces of said outer sleeves.

9. A marine propulsion device in accordance with claim 6 wherein said inner surfaces of said outer sleeves include a forward surface portion, wherein said outer surfaces of said inner sleeves include a forward surface portion, and wherein said rubber cores include a bumper portion extending from said forward surface portions of said inner surfaces of said outer sleeves and terminating in spaced relation to said forward surface portions of said inner sleeves.

10. A marine propulsion device in accordance with claim 1 wherein said fastening means comprises bolts respectively engaging said inner sleeves and threadedly engaged with said portion of said king pin assembly.

11. A marine propulsion device in accordance with claim 1 wherein said fastening means fixedly engages said outer sleeves with said socket and fixedly engages said inner sleeves with said portion of said king pin assembly.

12. An outboard motor comprising a drive shaft housing having forwardly located laterally spaced portions respectively including laterally aligned sockets respectively including vertically extending bottom walls respectively having therein horizontally extending apertures laterally aligned with each other and respective cylindrical walls extending from said bottom walls and opening laterally outwardly, a drive shaft extending vertically in said drive shaft housing, a king pin assembly comprising a steering arm including a rearwardly projecting portion located between said laterally extending portions and including a laterally extending bore aligned with said apertures, and a vertically extending aperture located forwardly of said bore and through which said drive shaft passes in spaced relation to said steering arm portion, rubber mount assemblies respectively engaged in said sockets and respectively including a rigid outer sleeve having a cylindrical outer surface, a rigid inner sleeve including an outer end and having a bore which is located in alignment with said bore in said king pin assembly and which is elongated in the fore and aft direction, and a resilient rubber core bonded to said inner and outer sleeves, a laterally extending bolt projecting through said bore in said steering arm portion in engagement therewith, through said bores in said inner sleeves in engagement therewith, and through said bottom wall apertures in spaced relation thereto and including a head engaging said outer end of one of said inner sleeves, and a nut threaded on said bolt and engaging said outer end of the other of said inner sleeves.

13. An outboard motor in accordance with claim 12 wherein said outer sleeves include an inner surface having upper and lower flat and forwardly convergent surface portions, wherein said inner sleeves include an outer surface including flat upper and lower surface portions, and wherein said rubber cores include upper and lower web portions respectively extending between said flat upper and lower surface portions of said outer surfaces of said inner sleeves and said flat upper and lower surface portions of said inner surfaces of said outer sleeves.

14. An outboard motor in accordance with claim 13 wherein said inner surfaces of said outer sleeves include a forward surface portion, wherein said outer surfaces of said inner sleeves include a forward surface portions, and wherein said rubber cores include bumper portion extending from said forward surface portions of said inner surfaces of said outer sleeves and terminating in spaced relation to said forward surface portions of said inner sleeves.

15. An outboard motor in accordance with claim 14 wherein said inner surfaces of said outer sleeves include a rearwardly located surface portion having a forwardly extending projection, wherein said outer surfaces of said inner sleeves include a rearward surface portion, and wherein said rubber cores include portions extending along said inner surfaces of said outer sleeves from said web portions and in spaced relation to said rearward surface portions of said outer surfaces of said inner sleeves and to adjacent said projections on said inner surfaces of said outer sleeves.

* * * * *